US005520280A

United States Patent [19]

Lickton

[11] Patent Number: 5,520,280

[45] Date of Patent: May 28, 1996

[54] BICYCLE SHIPPING CONTAINER

[75] Inventor: Robert J. Lickton, Elmwood Park, Ill.

[73] Assignee: R.L.L. Limited, Elmwood Park, Ill.

[21] Appl. No.: 490,015

[22] Filed: Jun. 13, 1995

[51] Int. Cl.[6] ..... B65D 85/06

[52] U.S. Cl. ..... 206/335; 190/18 A; 206/822; 280/47.26

[58] Field of Search ..... 190/18 A; 206/335, 206/551, 822; 280/47.19, 47.26, 47.27

[56] References Cited

U.S. PATENT DOCUMENTS

| | | | |
|---|---|---|---|
| 2,490,804 | 12/1949 | Haas | 206/335 |
| 2,908,383 | 10/1959 | Vogt . | |
| 3,734,272 | 5/1973 | Galen | 206/335 |
| 4,016,686 | 4/1977 | Hartger et al. | 206/335 |
| 4,339,041 | 7/1982 | Roberts et al. | 206/551 |
| 4,390,088 | 6/1983 | Brenner . | |
| 4,792,039 | 12/1988 | Dayton | 206/304 |
| 4,991,715 | 2/1991 | Williams | 206/335 |
| 5,169,164 | 12/1992 | Bradford | 190/18 A |
| 5,193,702 | 3/1993 | Shannon | 220/23.4 |
| 5,338,049 | 8/1994 | Goring | 280/47.19 |

FOREIGN PATENT DOCUMENTS

| | | | |
|---|---|---|---|
| 659245 | 12/1927 | France . | |
| 2396704 | 3/1979 | France . | |
| 3934946 | 4/1991 | Germany | 206/335 |
| 26142 | of 1896 | United Kingdom . | |

OTHER PUBLICATIONS

Bike Pro USA promotional literature (2 sheets).
Bicycle Catalog, pp. 63–64.

*Primary Examiner*—Jimmy G. Foster
*Attorney, Agent, or Firm*—Arnold, White & Durkee

[57] ABSTRACT

A rigid and compact bicycle shipping container is used to ship a bicycle having a detached front wheel, a rear wheel, a pair of pedals, handle bars, and a frame with a front fork. The container comprises opposing top and bottom walls, a pair of side walls, a rear wall, and various mounting elements mounted to the bottom wall to detachably engage the bicycle. Each of the top and bottom walls has a generally triangular shape. The pair of side walls and the rear wall bridge the opposing top and bottom walls. The side walls and the rear wall are arranged to form a triangle. The mounting elements include a front fork mount detachably engaging the front fork of the bicycle, a wheel mount detachably engaging the detached front wheel of the bicycle, and a wheel track receiving the rear wheel of the bicycle. The shipping container securely and stably holds a bicycle while requiring minimal disassembly thereof.

20 Claims, 5 Drawing Sheets

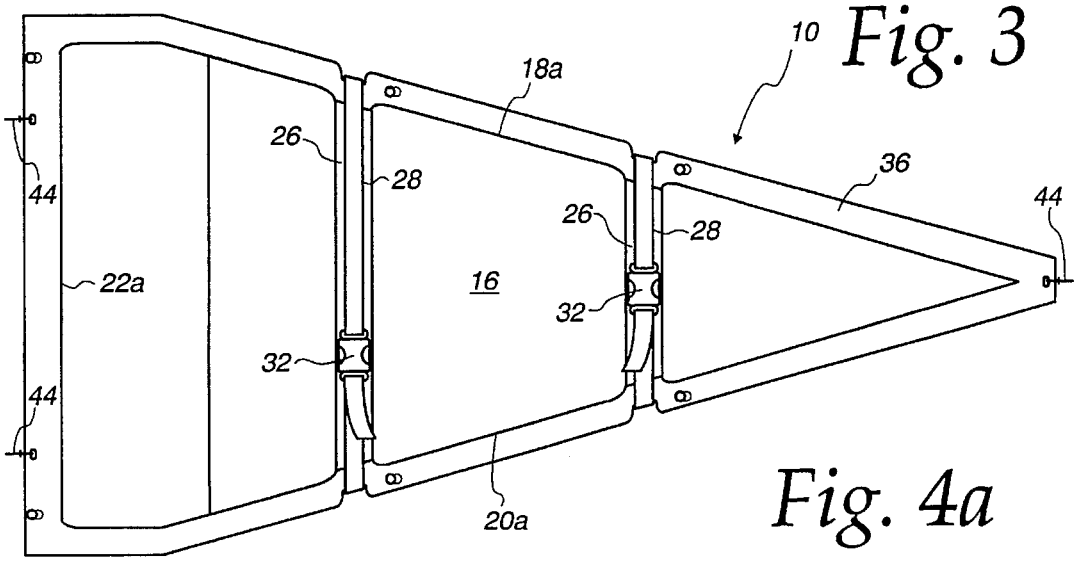
Fig. 3
Fig. 4a
Fig. 4b
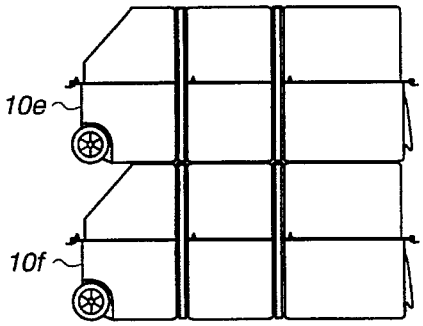
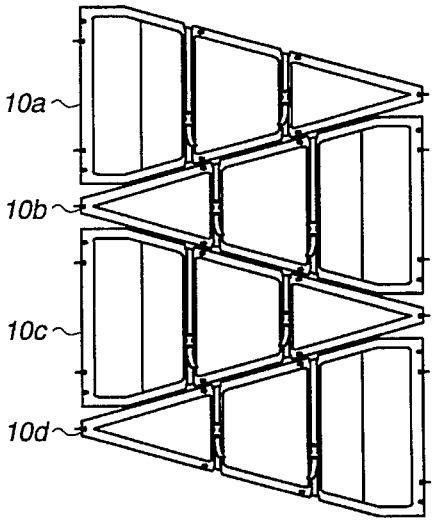
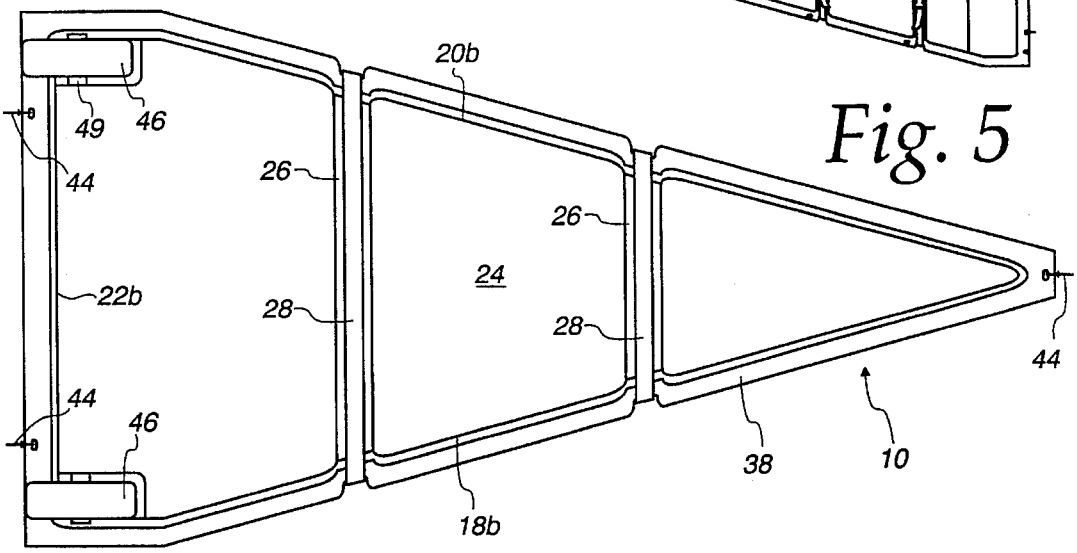
Fig. 5

BICYCLE SHIPPING CONTAINER

FIELD OF THE INVENTION

The present invention relates generally to containers for shipping bicycles and, more particularly, relates to a rigid and compact bicycle shipping container for securely and stably holding a bicycle while requiring minimal disassembly of the bicycle.

BACKGROUND OF THE INVENTION

Travelers, including recreational and professional cyclists, often require or desire the shipment of a bicycle by air or ground to a travel destination for use at that destination. To ship the bicycle to the travel destination, the bicycle often must be disassembled to some degree by detaching the wheels, the seat, and even the handle bars from the frame in order to fit the bicycle into the shipping container. The disassembler bicycle is then loaded into a hard-sided or soft-sided shipping container, which is placed with other air or ground cargo and shipped to the travel destination.

Existing bicycle shipping containers typically suffer from several drawbacks. First, with respect to shipping containers requiring disassembly of the bicycle prior to loading the bicycle into the shipping container, the disassembly is undesirable because it is time-consuming and often requires special tools. This required disassembly often deters recreational cyclists from bringing their bicycles with them on vacation.

Second, with respect to shipping containers which do not require disassembly of the bicycle, the shipping container is often quite bulky, thereby making the shipping container difficult to maneuver and causing the shipping container to occupy an inordinate amount of space. Such a bulky shipping container may be too large to fit inside some smaller cargo compartments.

Third, existing shipping containers often do not provide adequate stability to the contained bicycles and do not adequately protect the bicycles against damage caused by rough airline and freight handling. This inability to withstand rough airline and freight handling is especially a problem for soft-sided shipping containers. Damage caused to a bicycle during shipment thereof can be quite frustrating to the bicycle owner because the damaged bicycle may be unusable. If the bicycle owner is a professional cyclist and the bicycle is required for immediate use in competition, damage to that bicycle could place the cyclist in a disastrous position if the cyclist cannot quickly repair the damaged bicycle or procure a suitable replacement therefor. In the absence of insurance coverage, damage caused to a bicycle during shipment thereof can be quite costly to the bicycle owner because the damaged bicycle may need to be repaired or replaced in part or in whole. If, however, the bicycle owner is covered by insurance, damage to the bicycle is still costly in terms of the time required to settle the insurance claim.

A need therefore exists for a bicycle shipping container which overcomes the above-noted shortcomings associated with existing bicycle shipping containers.

SUMMARY OF THE INVENTION

A bicycle shipping container comprises opposing rigid top and bottom walls, and a pair of rigid side walls and a rigid rear wall bridging the opposing top and bottom walls. The pair of side walls and the rear wall are arranged to form a triangle which, in the preferred embodiment, is an isosceles triangle. In this isosceles triangle the pair of side walls are approximately equal in length and the rear wall is shorter in length than the pair of side walls. The rigidity of the top and bottom walls, the side walls, and the rear wall provides the container with impact resistance so that the container can withstand substantial abuse caused by mishandling thereof.

To load a bicycle into the container, only the front wheel of the bicycle is detached from the remainder of the bicycle. As most bicycles are provided with a quick-release lever for detachably engaging the front wheel, the detachment of the front wheel can be easily and quickly accomplished without the use of special tools. The bicycle with its detached front wheel is then loaded into the container within the area defined by the pair of side walls and the rear wall. The detached front wheel is loaded alongside the remainder of the bicycle so that the container can be relatively compact compared to some prior art bicycle shipping containers. The loaded bicycle is oriented generally perpendicular to the bottom wall and the rear wall of the container.

The container is provided with various support elements for securely and stably maintaining the bicycle within the container. In particular, a front fork mount is mounted on the bottom wall for detachably engaging the front fork of the bicycle. A wheel mount is mounted on the bottom wall for engaging the detached front wheel of the bicycle. A wheel track is formed in or mounted on the bottom wall for receiving the rear wheel of the bicycle and preventing lateral movement thereof. A pair of wheel retaining straps are preferably mounted to the bottom wall. When the bicycle is loaded into the container, one of these wheel retaining straps extends about the rim of the rear wheel to retain the rear wheel in the wheel track. The other of these wheel retaining straps extends about the rim of the front wheel to stabilize the front wheel.

In the preferred embodiment, a pedal retaining strap is mounted to the bottom wall. When the bicycle is loaded into the container, the pedal retaining strap extends from the bottom wall about one of the bicycle pedals to fix the position of the bicycle pedals and thereby prevent rotation of the front sprocket wheel of the bicycle while the container is in transit. The pedal retaining strap also assists in maintaining the rear wheel of the bicycle in the wheel track.

In the preferred embodiment, one or more wheels are mounted to an axle which is, in turn, mounted to one end of the container. The axle is generally parallel to and is disposed in proximity to the bottom wall and the rear wall. A handle is mounted to an opposite end of the container relative to the axle and wheels to permit easy transport of the container. An individual moves the container by grasping the handle to tip the handle end of the container off the surface (e.g., ground or floor) supporting the container and by pulling on the container while the handle end is lifted off the supporting surface.

The above summary of the present invention is not intended to represent each embodiment, or every aspect, of the present invention. This is the purpose of the figures and the detailed description which follow.

BRIEF DESCRIPTION OF THE DRAWINGS

Other objects and advantages of the invention will become apparent upon reading the following detailed description and upon reference to the drawings in which:

FIG. 3 is a top view of the closed bicycle container in FIG. 1;

FIG. 4*a* is a top view of several closed bicycle containers arranged adjacent to each other so as to fit inside a smaller cargo compartment;

FIG. 4*b* is a side view of a pair of stacked bicycle containers;

FIG. 5 is a bottom view of the closed bicycle container in FIG. 1;

Figure 1:
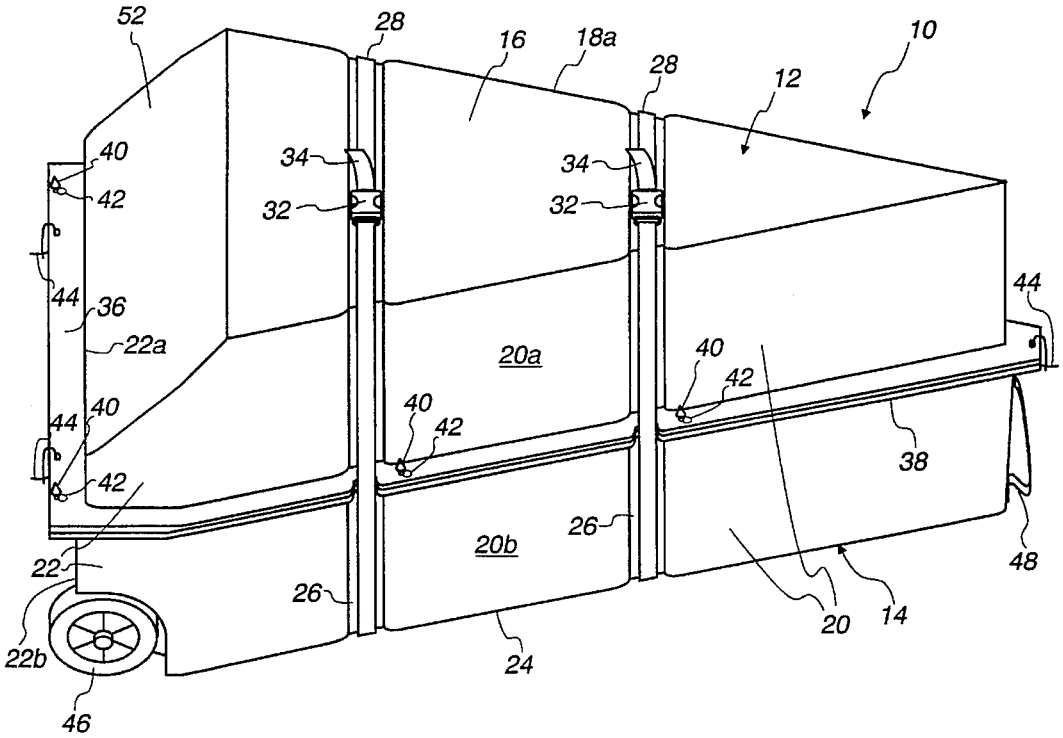
FIG. 1 is a perspective view of a closed triangular bicycle shipping container embodying the present invention.

While the invention is susceptible to various modifications and alternative forms, a specific embodiment thereof has been shown by way of example in the drawings and will be described in detail. It should be understood, however, that it is not intended to limit the invention to the particular form described, but, on the contrary, the intention is to cover all modifications, equivalents, and alternatives falling within the spirit and scope of the invention as defined by the appended claims.

DETAILED DESCRIPTION OF THE PREFERRED EMBODIMENT

Figure 2:
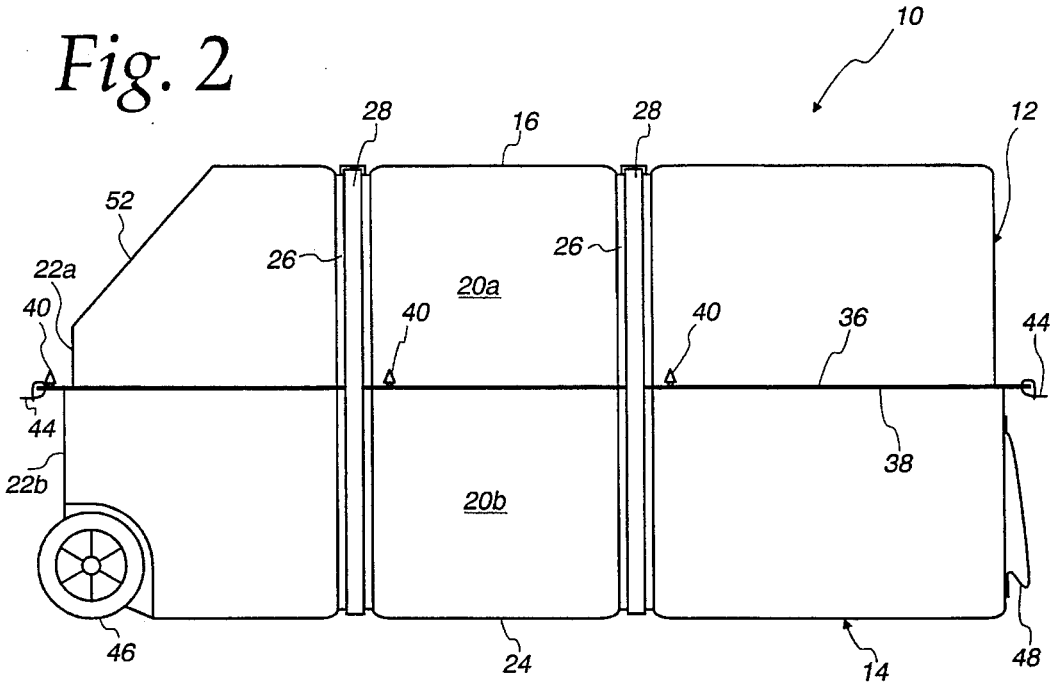
FIG. 2 is a side view of the closed bicycle container in FIG. 1.

Turning now to the drawings, FIGS. 1, 2, 3, and 5 depict a closed triangular bicycle shipping container 10 for securely and stably holding a bicycle while requiring minimal disassembly of the bicycle. FIG. 1 is a perspective view of the closed container 10; FIG. 2 is a side view of the closed container 10; FIG. 3 is a top view of the closed container 10; and FIG. 5 is a bottom view of the closed container 10.

The closed container 10 includes a rigid top section 12 and a rigid bottom section 14 composed of recycled or virgin polymeric (plastic) materials such as rugged high-density polyethylene (FIGS. 1 and 2). The rigid top section 12 is in the form of an inverted triangular tray having a top wall 16, a pair of side walls 18*a* and 20*a*, and a rear wall 22*a* extending downward from the top wall 16 (FIGS. 1 and 3). The rigid bottom section 14 is in the form of a triangular tray having a bottom wall 24, a pair of side walls 18*b* and 20*b*, and a rear wall 22*b* extending upward from the bottom wall 24 (FIGS. 1 and 5). The pair of side walls 18*a* and 20*a*and rear wall 22*a* of the top section 12 combine with the respective pair of side walls 18*b* and 20*b* and rear wall 22*b* of the bottom section 14 to provide the container 10 with a pair of side walls 18 and 20 and a rear wall 22 (FIG. 1). The top wall 16 is generally parallel to the bottom wall 24 (FIG. 1). The top and bottom sections 12 and 14 are preferably manufactured using conventional insert-molding techniques.

The closed container 10 is generally in the form of a triangular polyhedron. As best shown in FIGS. 3 and 5, the side walls 18 and 20 and the rear wall 22 of this polyhedron define an isosceles triangle where the side walls 18 and 20 are substantially equal in length and the rear wall 22 is shorter in length than the side walls 18 and 20. In the preferred embodiment, the rear wall 22 is approximately one-half the length of the side walls 18 and 20. The rear wall 22 preferably has a length between about 28 inches (71 cm) and about 34 inches (84 cm). The side walls 18 and 20 preferably have a length between about 66 inches (168 cm) and about 72 inches (183 cm). The distance between the opposing top and bottom walls 16 and 24, i.e., the height of the side walls 18 and 20 and rear wall 22, is between about 32 inches (81 cm) and 36 inches (91 cm).

To maintain the bicycle shipping container 10 in the closed position, the top wall 16, the side walls 18 and 20, and the bottom wall 24 form a pair of grooves 26 which receive respective straps 28. The grooves 26 fix the position of the straps 28 and thereby prevent lateral shifting of the straps 28. As best shown in FIGS. 1 and 5, the straps 28 are disposed within the grooves 26 outside the container 10 along the top wall 16 (FIG. 1), the side walls 18 and 20 (FIG. 1), and the bottom wall 24 (FIG. 5). The straps 28 are preferably composed of a flexible material such as woven fabric.

Conventional snap-lock buckles 32 are used to detachably engage the ends of each strap 28. The buckles 32 are preferably positioned within the grooves 26 along the top wall 16 of the container 10. To insure that the straps 28 are taut when the container 10 is closed, any slack in the straps 28 can be eliminated by pulling on free end sections of the straps 28 extending from the buckles 32.

The top section 12 of the container 10 forms a continuous peripheral lip 36 extending from the lowermost edges of the side walls 18*a* and 20*a*and the rear wall 22*a* (FIGS. 1, 2, and 3). Similarly, the bottom section 14 forms a continuous peripheral lip 38 extending from the uppermost edges of the side walls 18*b* and 20*b* and the rear wall 22*b* (FIGS. 1, 2, and 5). When the bicycle shipping container 10 is closed, the peripheral lip 36 sits on the peripheral lip 38. The container 10 is provided with various means for preventing the lips 36 and 38 from sliding relative to each other and further maintaining the container 10 in the closed position. For example, the lip 38 forms a plurality of nipples 40 which protrude through respective apertures 42 formed by the lip 36. The number, arrangement, and spacing of the nipples 40 corresponds to the number, arrangement, and spacing of the apertures 42. Alternatively, the lips 36 and 38 may form mating bumps and indentations. Furthermore, a plurality of flexible fastening straps 44, preferably composed of plastic, extend through aligned holes formed in the lips 36 and 38. In addition, the anchoring of the straps 28 in the grooves 26 discourages relative sliding of the lips 36 and 38. The lips 36 and 38 preferably form notches in line with the grooves 26 to accommodate the straps 28.

To facilitate movement of the closed container 10, the container 10 is provided with a pair of wheels 46 and a flexible strap handle 48. The handle 48, preferably composed of a flexible material such as woven fabric, is mounted to the bottom container section 14 at the junction of the side walls 18*a* and 20*a*. The wheels 46 are rotatably mounted to an axle 49 (FIG. 5) attached to the bottom container section 14. The axle 49 is generally parallel to the bottom wall 24 and the rear wall 22*b*. The axle 49 extends through the interior of the container in closed proximity to the junction of the bottom wall 24 and the rear wall 22*b*. Two corners of the bottom section 14 are recessed to accommodate and partially conceal the wheels 46, which are located at opposite ends of the axle 49. The axle 49 is located a sufficient distance away from the flat portion of the bottom wall 24 that the wheels 46 do not contact a surface (e.g., ground or floor) supporting the container 10 when the flat portion of the bottom wall 24 is abutting this supporting surface (FIG. 2).

To move the container 10 relative to the supporting surface, a user grasps the handle 48 and lifts (tips) the handle end of the container 10 off the supporting surface. With the handle end of the container 10 lifted off the supporting surface, the wheels 46 come into contact with the supporting surface. In response to pulling the tipped container 10 by the handle 48, the wheels 46 roll along the supporting surface and thereby cause movement of the container 10.

As best shown in FIG. 4*a*, a plurality of closed bicycle shipping containers 10 can be closely arranged to fit in a small area by arranging adjacent containers to point in opposite directions. In FIG. 4*a*, for example, the container 10*b* is oriented in an opposite direction relative to its adjacent containers 10*a*and 10*c* so that the container 10*b* is essentially nested between the containers 10*a*and 10*c*. Similarly, the container 10*c* is oriented in an opposite direction relative to the adjacent containers 10*b* and 10*d* so that the container 10*c* is essentially nested between the containers 10*b* and 10*d*. It can be seen that the close arrangement of the containers in FIG. 4*a* directly follows from the triangular shape of the container 10. To maintain the containers in FIG. 4*a* in close side-by-side relationship while the containers are in transit, adjacent comers of adjacent containers may be interconnected using straps akin to the strap handle 48. The comer straps are provided with buckles to permit interconnection of adjacent corner straps. The interconnection of adjacent corner straps minimizes shifting of the containers in FIG. 4*a* relative to each other.

In addition to arranging containers 10 side-by-side as shown in FIG. 4*a*, a plurality of containers 10 may be stacked on top of one another as shown in FIG. 4*b*. Specifically, FIG. 4*b* depicts the container 10*e* stacked on top of the container 10*f* with the bottom wall of the container 10*e* abutting the top wall of the container 10*f*. The number of containers which may be stacked on top of one another is determined by the height of the cargo compartment into which the containers are loaded for shipment.

Figure 6:
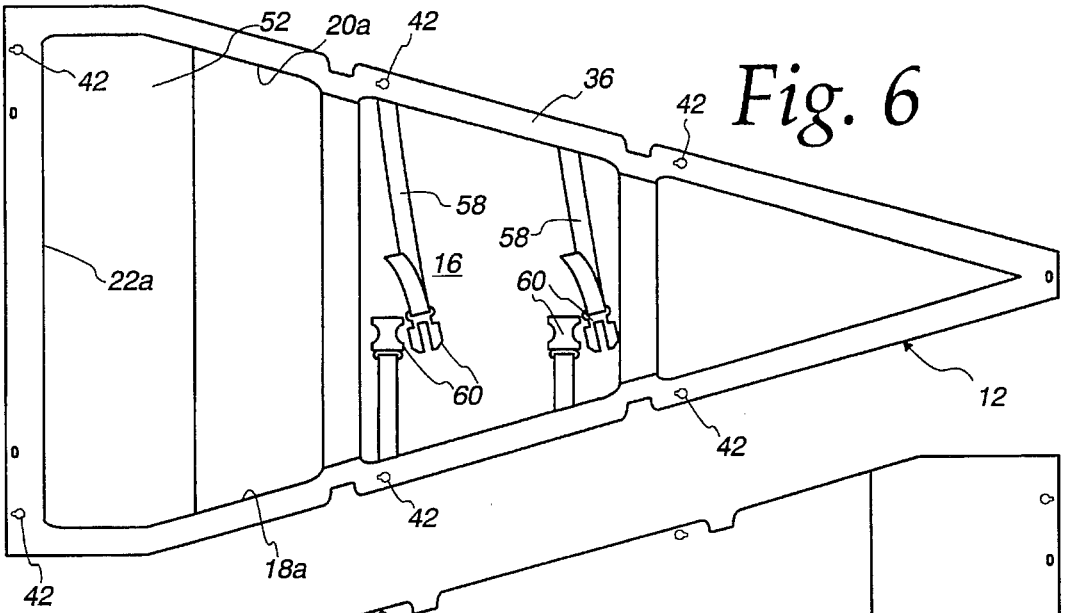
FIG. 6 is a top view of an inverted top section of the bicycle container in FIG. 1.
Figure 7:
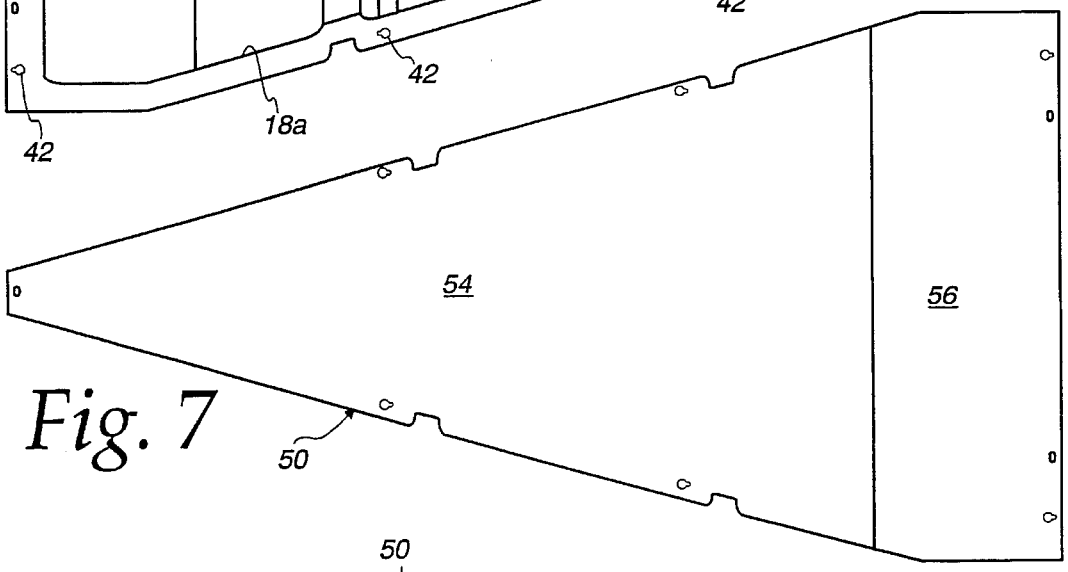
FIG. 7 is a top view of a lid adapted to fit within the inverted top container section in FIG. 6.
Figure 8:
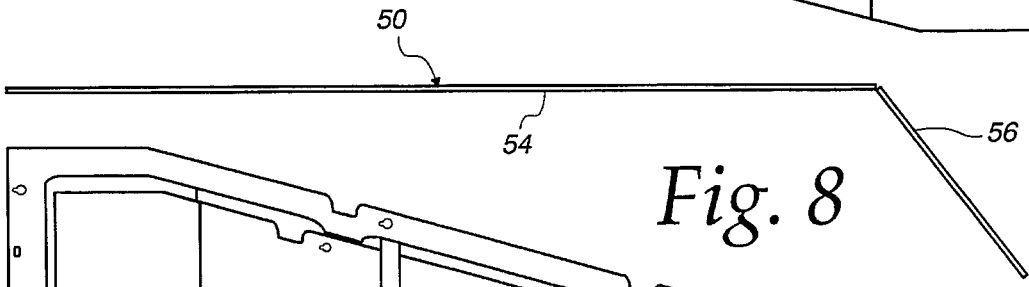
FIG. 8 is a side view of the lid in FIG. 7 with a hinged flap rotated to permit insertion of the lid into the inverted top container section in FIG. 6.
Figure 9:
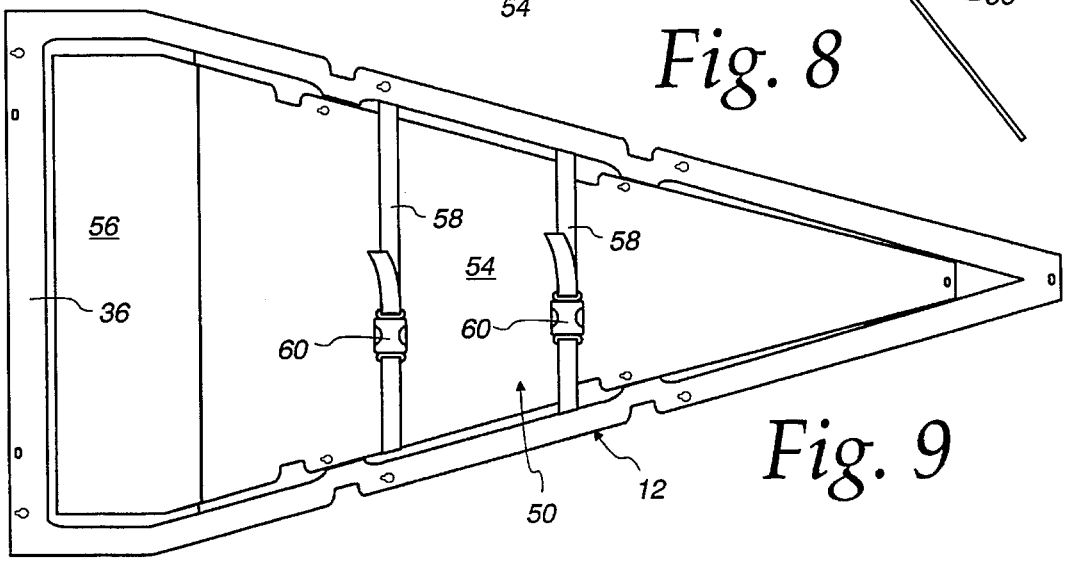
FIG. 9 is a top view of the inverted top container section in FIG. 6 with the lid in FIG. 7 inserted therein.

FIGS. 6–9 depict the top container section 12 and a generally triangular molded plastic lid 50 adapted to snugly fit within the top section 12. When the container 10 is used to ship a bicycle, the lid 50 is secured in the top section 12 against the top wall 16 (FIG. 9). The top wall 16 includes a sloped section 52 adjacent to the rear wall 22*a* of the top section 12 (FIGS. 1, 2, and 6). To permit the lid 50 to conform to the shape of the top wall 16 when secured adjacent thereto, the lid 50 includes a primary portion 54 and a secondary portion 56 hingedly connected to the primary portion 54 by means of a conventional hinge (FIGS. 7 and 8). When the lid 50 is positioned immediately adjacent to the top wall 16, the primary portion 54 abuts the flat portion of the top wall 16 and the secondary portion 56 abuts the sloped section 52 of the top wall 16 (FIG. 9). The secondary portion 56 of the lid 50 is oriented at an angle relative to the primary portion 54 corresponding to the angle between the sloped section 52 and the fiat portion of the top wall 16 (FIGS. 8 and 9). To secure the lid 50 within the top container section 12, a retaining strap 58 extends from opposing edges of the top wall 16 over the lid 50 such that the lid 50 is held by the strap 58 against the top wall 16 (FIGS. 6 and 9). A conventional snap-lock buckle 60 allows the strap 58 to releasably retain the lid 50. The strap 58 is preferably composed of a flexible material such as woven fabric.

Figure 10:
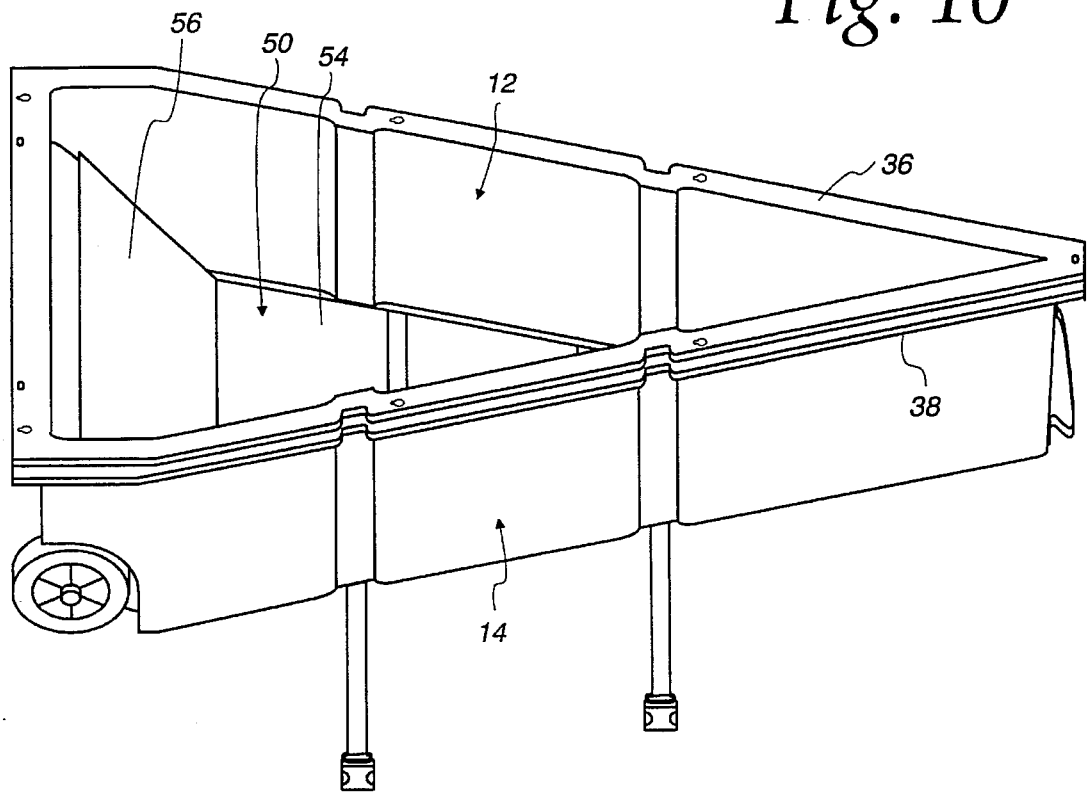
FIG. 10 is a perspective view of the bicycle shipping container embodying the present invention showing the lid inserted into the inverted top section and showing the inverted top section inserted into the bottom section.
Figure 11:
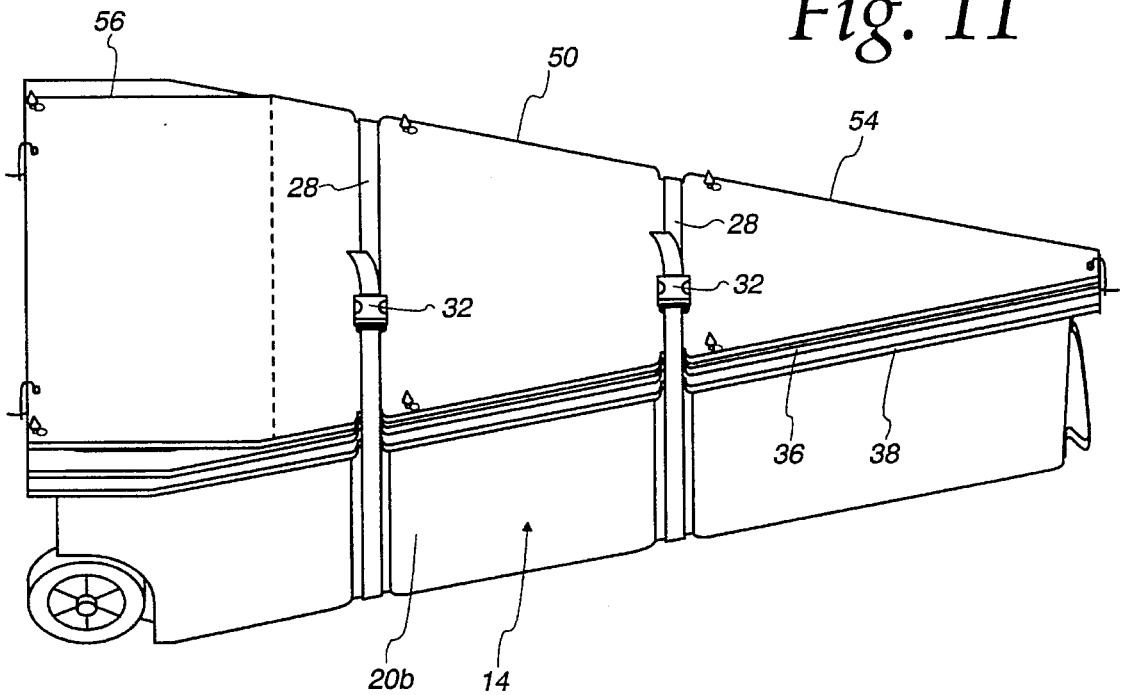
FIG. 11 is a perspective view of the bicycle shipping container embodying the present invention showing the container closed by the lid.

Referring to FIGS. 10 and 11, when the container 10 is used to ship items other than a bicycle, such as luggage, golf clubs, etc., the top section 12 is inverted and inserted into the bottom section 14 as illustrated in FIG. 10. The top and bottom sections 12 and 14 are properly configured so that the top section 12 is snugly nested into the bottom section 14. The inserted top section 12 conceals support elements on the bottom wall 24 of the bottom section 14 used to mount a bicycle to the bottom wall 24 as described below in connection with FIGS. 12 and 13. Next, the buckle 60 of the lid retaining strap 58 is disengaged (FIGS. 6 and 9) and the lid 50 is removed from the top section 12. The removed lid 50 is then rested on and secured to the lip 36 of the top section 12 using the straps 28 and snap-lock buckles 32 (FIG. 11). The straps 28 are disposed outside the container 10 along the lid 50 and along the side walls 18*b* and 20*b* of the bottom section 14. The straps 28 are disposed inside the container 10 along the bottom wall 24. Thus, the straps 28 which are used to maintain the container 10 in a first closed configuration when the container 10 holds a bicycle (FIG. 1) are also used to maintain the container 10 in a second closed configuration when the container 10 holds items other than a bicycle (FIG. 11).

When the lid 50 is rested on the lip 36, the secondary portion 56 of the lid 50 rotates relative to the primary portion 54 such that the primary and secondary portions 54 and 56 are co-planar with each other. The primary and secondary portions 54 and 56 are sized such that when the lid 50 is removed from the top section 12 and the primary and secondary portions 54 and 56 become co-planar with each other, the lid 50 substantially covers the lip 36 (FIG. 11). As viewed in FIG. 11, the narrow right portion of the lid 50 covers the rightmost portion of the lip 36 and the wide left portion of the lid 50 covers the leftmost portion of the lip 36.

Figure 13:
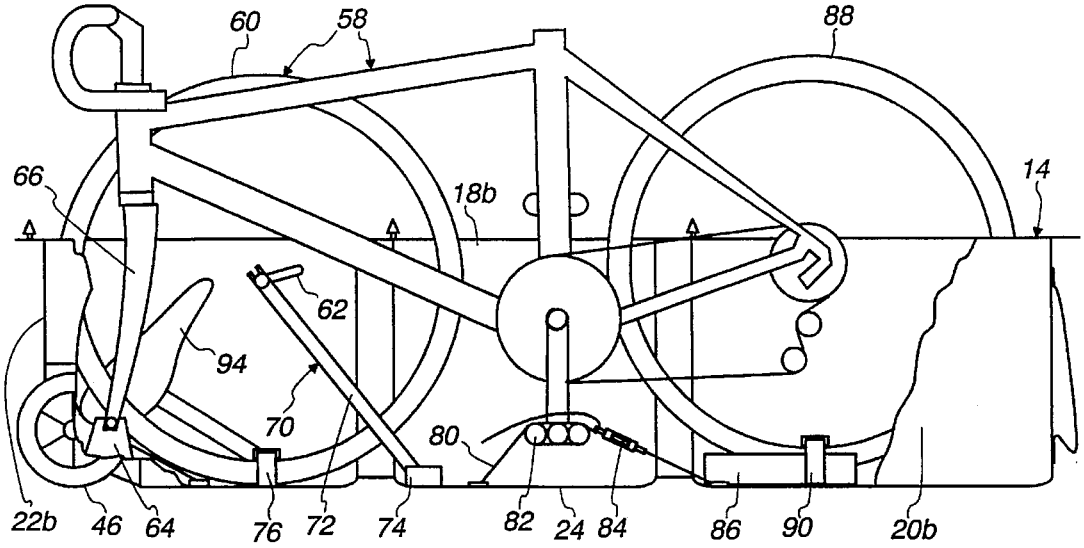
FIG. 13 is a side view of the bottom container section in FIG. 12 having portions broken away to reveal internal structure and having a bicycle loaded into the bottom container section.

When the container 10 is used to ship a bicycle, the lid 50 is secured within the top section 12 as shown in FIG. 10; the top section 12 is removed from the bottom section 14; a bicycle is loaded into and mounted within the bottom section 14 as shown in FIG. 13; and the top section 12 is connected to the bottom section 14 as shown in FIG. 1 to enclose the bicycle within the container 10.

Figure 12:
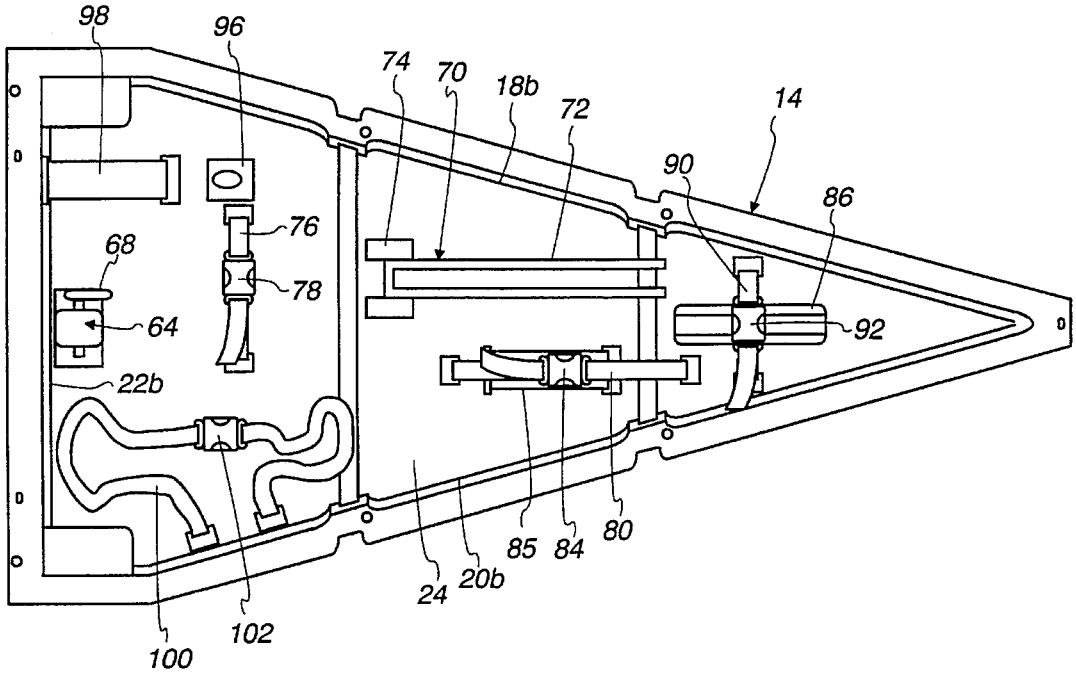
FIG. 12 is a top view of a bottom section of the bicycle container in FIG. 1.

Referring to FIGS. 12 and 13, to load a bicycle 58 into the bottom container section 14, a front wheel 60 of the bicycle 58 is detached from the remainder of the bicycle. As most bicycles are provided with a quick-release lever 62 for detachably engaging the front wheel 60, the detachment of the front wheel 60 can be easily and quickly accomplished without the use of special tools. The bicycle 58 with its detached front wheel 60 is then loaded into the bottom section 14 within the area defined by the side walls 18*b* and 20*b* and the rear wall 22*b*. The detached front wheel 60 is loaded alongside the remainder of the bicycle 58 so that the container 10 can be relatively compact compared to some prior art bicycle shipping containers. The loaded bicycle 58 is oriented generally perpendicular to the bottom wall 24 and the rear wall 22*b* of the bottom section 14.

The bottom container section 14 is provided with various support elements for securely and stably maintaining the bicycle 58 within the bottom section 14. In particular, a metallic front fork mount 64 is mounted on the bottom wall 24 for detachably engaging a front fork 66 of the bicycle 58. The front fork mount 64 includes a conventional quick-release lever 68 akin to the quick-release lever 62 to permit the front fork mount 64 to releasably engage the front fork 66 of the bicycle 58.

A metallic or rigid plastic wheel mount 70 is mounted on the bottom wall 24 for engaging the detached front wheel 60 of the bicycle 58. The wheel mount 70 includes a fork 72 rotatably mounted to a pivot 74 which is, in turn, fixedly mounted to the bottom wall 24. The pivot 74 allows the fork 72 to rotate between a horizontal position (FIG. 12) and an upright position (FIG. 13). When no bicycle is loaded into the bottom section 14 and the container 10 is used to store items other than a bicycle (FIGS. 10 and 11), the fork 72 of the wheel mount 70 is disposed in the horizontal position so that the fork 72 does not interfere with the inverted top section 12 when the inverted top section 12 is inserted into the bottom section 14 (FIG. 10). When the bicycle 58 is loaded into the bottom section 14, the fork 72 of the wheel mount 70 is rotated to the upright position (FIG. 13). With the fork 72 in this upright position, the quick-release lever 62 on the detached front wheel 60 is used to releasably engage the front wheel 60 of the bicycle 58 to the fork 72.

Once the front wheel 60 is engaged to the wheel mount 70, a wheel retaining strap 76 mounted to the bottom wall 24 is used to further secure and stabilize the front wheel 60. The strap 76, preferably composed of a flexible material such as woven fabric, extends about the rim of the front wheel 60 (FIG. 13), and a conventional snaplock buckle 78 is employed to fasten the two loose ends of the strap 76. The strap 76 firmly holds the tire of the front wheel 60 against the bottom wall 24 to restrict movement of the front wheel 60 while it is mounted to the wheel mount 70.

A pedal retaining strap 80, preferably composed of a flexible material such as woven fabric, is mounted to the bottom wall 24. When the bicycle 58 is loaded into the bottom section 14, the pedal retaining strap 80 extends from the bottom wall 24 about one of the bicycle pedals 82 to fix the position of the bicycle pedals 82 and thereby prevent rotation of the front sprocket wheel of the bicycle 58 while the container 10 is in transit. Prior to securing the pedal 82, it is preferably rotated so that it is at a downward position closest to the bottom wall 24. A conventional snap-lock buckle 84 is used to fasten the loose ends of the strap 80. With some bicycles, the pedal 82 may contact the bottom wall 24 of the container 10. To prevent the pedal 82 from causing abrasion to the bottom wall 24, especially while the container 10 is in transit, a nonabrasive material 85 such as a soft cloth or carpet may be mounted on the bottom wall 24 such that the pedal 84 bears against the non-abrasive material 85 rather than the rigid bottom wall 24.

A wheel track or groove 86 is formed in or mounted on the bottom wall 24 for receiving a rear wheel 88 of the bicycle 58 and preventing lateral movement thereof. To accommodate rear wheels with tires of varying widths, the wheel track 86 gradually narrows from its upper end to its lower end such that narrower tires are seated deeper in the wheel track 86 than wider tires. Once the rear wheel 88 is seated in the wheel track 86, the pedal retaining strap 80 assists in maintaining the rear wheel 88 of the bicycle 58 in the wheel track 86. If desired, an additional wheel retaining strap 90 may be employed to retain the rear wheel 88 in the wheel track 86. The strap 90 extends about the rim of the rear wheel 88, and a snap-lock buckle 92 is used to fasten the loose ends of the strap 90.

Many bicycles 58, such as mountain bicycles, city bicycles, and small-framed touring and racing bicycles (road bicycles), are sufficiently short to fit within the container 10 without detaching the bicycle seat 94. However, to accommodate touring and racing bicycles having larger frames, the bicycle seat 94 is detached from the bicycle frame prior to closing the container 10. The detached bicycle seat 94 is mounted to a metallic seat mount 96 (FIG. 12) connected to the bottom wall 24. The seat mount 96 forms an aperture for receiving the post of the bicycle seat 94. To prevent abrasion of the bicycle seat 94 while the container 10 is in transit, a non-abrasive material 98 such as a soft cloth or carpet may be mounted on the bottom wall 24 such that the mounted bicycle seat 94 bears against the non-abrasive material 98 rather than the rigid bottom wall 24.

The position of the bicycle 58 within the bottom section 14 is apparent based on the locations of the various support elements used to secure and stabilize the bicycle 58. The main portion of the bicycle 58, including the frame (with front fork 66) and the rear wheel 88, is located approximately halfway between the side walls **18*b* and 20*b* and extends generally from the rear wall 22*b* to the junction of the side walls 18*b* and 20*b*. The front fork 66 is located in close proximity to the rear wall 22*b*, while the rear wheel 88 is located in close proximity to the junction of the side walls 18*b* and 20*b*. The detached front wheel 60 is located alongside the main bicycle portion between the main bicycle portion and the side wall 18*b*. The front wheel 60 is located in close proximity to the side wall 18*b* and the rear wall 22*b*. If the bicycle seat 94 is detached from the bicycle frame, the bicycle seat 94 is located alongside the detached front wheel 60 between the front wheel 60 and the side wall 18*b*. The bicycle seat 94 is located in close proximity to the side walls 18*b* and 20*b***.

Since the region of the bottom container section 14 between the main bicycle portion and the side wall **20*b* is unoccupied by detached bicycle components and mounting elements (except for the pedal retaining strap 80), this unoccupied region may be used to store additional items besides the bicycle 58. For example, one or more pieces of luggage may be stored in this region. To secure these additional items, one or more miscellaneous retaining straps 100 are mounted to the bottom wall 24. A snaplock buckle 102 is used to fasten the loose ends of each strap 100. The straps 100** are preferably composed of a flexible material such as woven fabric.

An important feature of the present invention is the generally triangular shape of the container 10. It can be seen from FIGS. 12 and 13 that the wide portion of the bottom section 14 accommodates the main bicycle portion, the detached front wheel 60, the detached seat 94, and extra items loaded into the unoccupied region of the bottom section 14. The wide portion of the top section 12, which is connected to the bottom section 12 as shown in FIG. 1, accommodates the main bicycle portion (especially the handle bars thereof), the detached front wheel 60, and any extra items loaded into the bottom section 14 which are taller than the height of the bottom section 14. The wide portion of the top section 12 makes it unnecessary to detach the handle bars of the bicycle 58. The narrow portion of the top and bottom sections 12 and 14 need only be sufficiently wide to accommodate the rear wheel 88 of the bicycle 58.

While the present invention has been described with reference to one or more particular embodiments, those skilled in the art will recognize that many changes may be made thereto without departing from the spirit and scope of the present invention. Each of these embodiments and obvious variations thereof is contemplated as falling within the spirit and scope of the invention, which is set forth in the following claims.

What is claimed is:

1. A bicycle shipping container for shipping a bicycle having a front wheel, a rear wheel, a pair of pedals, handle bars, and a frame with a front fork, the front wheel being detached from the frame, said container comprising:

opposing rigid top and bottom walls, each of said top and bottom walls having a generally triangular shape;

a pair of rigid side walls and a rigid rear wall bridging said opposing top and bottom walls, said side walls and said rear wall being arranged to form a triangle;

means, mounted to said bottom wall, for detachably engaging the front fork of the bicycle;

means, mounted to said bottom wall, for detachably engaging the detached front wheel of the bicycle; and means, disposed at said bottom wall, for restraining the rear wheel of the bicycle.

2. The container of claim 1, wherein said means for detachably engaging the front fork of the bicycle includes a front fork mount.

3. The container of claim 1, wherein said means for detachably engaging the front wheel of the bicycle includes a wheel mount.

4. The container of claim 3, wherein said means for detachably engaging the front wheel of the bicycle includes a wheel retaining strap extending about a rim of the front wheel to hold the rim adjacent to said bottom wall.

5. The container of claim 1, wherein said means for restraining the rear wheel of the bicycle includes a wheel track along said bottom wall, the rear wheel sitting in said wheel track.

6. The container of claim 5, wherein said means for restraining the rear wheel of the bicycle includes a wheel retaining strap extending about a rim of the rear wheel to hold the rear wheel in said wheel track.

7. The container of claim 5, wherein said means for restraining the rear wheel of the bicycle includes a pedal retaining strap extending from said bottom wall about one of the pedals to simultaneously restrict movement of the pedals and hold the rear wheel in said wheel track.

8. The container of claim 1, wherein said means for detachably engaging the front fork, said means for detachably engaging the detached from wheel, and said means for restraining the rear wheel are arranged on said bottom wall relative to each other such that the frame and the rear wheel are disposed between said pair of side walls, the front fork and the handle bars are disposed in proximity to said rear wall, and the detached front wheel is disposed generally alongside the frame.

9. The container of claim 1, wherein said means for detachably engaging the front fork, said means for detachably engaging the detached front wheel, and said means for restraining the rear wheel are configured to secure the bicycle generally perpendicular to said bottom wall and said rear wall.

10. The container of claim 1, further including means, mounted to said bottom wall, for restricting movement of the pedals of the bicycle.

11. The container of claim 10, wherein said means for restricting movement of the pedals includes a pedal retaining strap extending from said bottom wall about one of the pedals.

12. The container of claim 1, further including a pair of wheels disposed near opposite ends of said rear wall in proximity to said bottom wall and said side walls, and further including an external handle mounted at a junction of said side walls.

13. The container of claim 1, wherein said side walls are approximately equal in length and said rear wall is shorter in length than each of said side walls so that said triangle formed by said side walls and said rear wall is substantially isosceles.

14. A bicycle shipping container for shipping a bicycle, said container comprising:

a rigid top section forming a top wall, a pair of first side walls, and a first rear wall, said pair of first side walls and said first rear wall extending downward from said top wall and being arranged to form a first triangle;

a rigid bottom section forming a bottom wall, a pair of second side walls, and a second rear wall, said pair of second side walls and said second rear wall extending upward from said bottom wall and being arranged to form a second triangle, said bottom section being detachably connected to said top section to form a generally triangular polyhedron with said top wall opposing said bottom wall, said pair of first side walls joining with respective ones of said pair of second side walls to form a pair of combined side walls, and said first rear wall joining with said second rear wall to form a combined rear wall; and mounting elements mounted to said bottom wall to detachably engage the bicycle.

15. The container of claim 14, wherein the bicycle includes a front wheel, a rear wheel, and a frame with a front fork, the front wheel being detached from the frame; and wherein said mounting elements include a front fork mount detachably engaging the front fork of the bicycle, a wheel mount detachably engaging the detached front wheel of the bicycle, and a wheel track receiving the rear wheel of the bicycle.

16. The container of claim 14, wherein said mounting elements are arranged on said bottom wall relative to each other such that the frame and the rear wheel are disposed between said pair of combined side walls, the front fork and handle bars are disposed in proximity to said combined rear wall, and the detached front wheel is disposed generally alongside the frame.

17. The container of claim 16, wherein said mounting elements are configured to secure the bicycle generally perpendicular to said bottom wall and said combined rear wall.

18. The container of claim 14, wherein said pair of first side walls and said pair of second side walls are approximately equal in length, and wherein said first and second rear walls are approximately equal in length and are shorter in length than said pair of first side walls and said pair of second side walls so that said first and second triangles are substantially isosceles.

19. The container of claim 14, further including a lid releasably secured within said top section adjacent to said top wall, said lid being adapted to cover said top section in response to detaching said top section from said bottom section, inverting said top section, removing said lid from within said top section, and sitting said lid on uppermost edges of said first side walls and said first rear wall.

20. A multi-purpose shipping container transformable between a first configuration and a second configuration, the container storing a bicycle in the first configuration and storing miscellaneous items in the second configuration, said container comprising:

a rigid triangular bottom tray having a bottom wall and a first plurality of side walls extending from said bottom wall;

a rigid triangular top tray having a horizontal wall and a second plurality of side walls extending from said horizontal wall;

a lid releasably secured to said top tray; and mounting elements, mounted to said bottom wall, for detachably engaging the bicycle within said bottom tray in the first configuration of the container;

wherein in the first configuration, said lid is secured within said top tray adjacent to said horizontal wall, and said top tray is secured to said bottom tray to form a generally triangular polyhedron with said horizontal wall forming a top wall opposing said bottom wall and with said first and second pluralities of side walls forming sides of said polyhedron bridging said opposing top and bottom walls; and wherein in the second configuration, said top tray is nested within and secured to said bottom tray with said horizontal wall adjacent to said bottom wall and with said first plurality of side walls generally overlapping said second plurality of side walls, and said lid is secured to uppermost edges of said second plurality of side walls such that said lid opposes said horizontal wall and said second plurality of side walls bridge said opposing lid and horizontal wall.

* * * * *